United States Patent [19]

Makhlouf

[11] Patent Number: 4,928,558

[45] Date of Patent: May 29, 1990

[54] TORQUE MASTER

[76] Inventor: Samir B. Makhlouf, 36 Huyler Ct., Setauket, N.Y. 11733

[21] Appl. No.: 284,737

[22] Filed: Dec. 15, 1988

[51] Int. Cl.[5] ..... B25B 17/00

[52] U.S. Cl. ..... 81/57.3; 81/57.14; 81/57.29; 81/57.13; 81/58.2

[58] Field of Search ..... 81/55, 57–57.14, 81/57.29, 58.2

[56] References Cited

U.S. PATENT DOCUMENTS

| | | | |
|---|---|---|---|
| 2,523,193 | 9/1950 | Carson | 81/57.3 X |
| 2,527,033 | 10/1950 | Rodgers et al. | 81/58.2 |
| 3,218,893 | 11/1965 | Madison et al. | 81/55 |
| 3,977,278 | 8/1976 | Jackson | 81/57.11 |
| 4,215,601 | 8/1980 | Mann | 81/57.13 |
| 4,231,271 | 11/1980 | Yamada | 81/57.3 |
| 4,274,310 | 6/1981 | Michaud | 81/57.3 X |
| 4,362,072 | 12/1982 | Tillman | 81/57.13 X |
| 4,374,479 | 2/1983 | Minotti | 81/57.3 |
| 4,506,567 | 3/1985 | Makhlouf | 81/57.3 |
| 4,573,377 | 3/1986 | Sroka | 81/57.3 X |
| 4,790,218 | 12/1988 | Cabrera | 81/57.29 X |

*Primary Examiner*—James G. Smith
*Attorney, Agent, or Firm*—Leonard Belkin

[57] ABSTRACT

A torque multiplying wrench having rotatable jaws at one end to deliver the torque and a driven member at the opposite end to receive the input torque. The driven member is connected to the driven jaws by a plurality of gears mounted on posts spaced within the housing along the length of the wrench. The gears and posts are readily removable to replace any failed gears or posts. Provision is included to absorb reaction forces. In other embodiment, provision is made for a powered input to the wrench.

11 Claims, 5 Drawing Sheets

FIG. 1
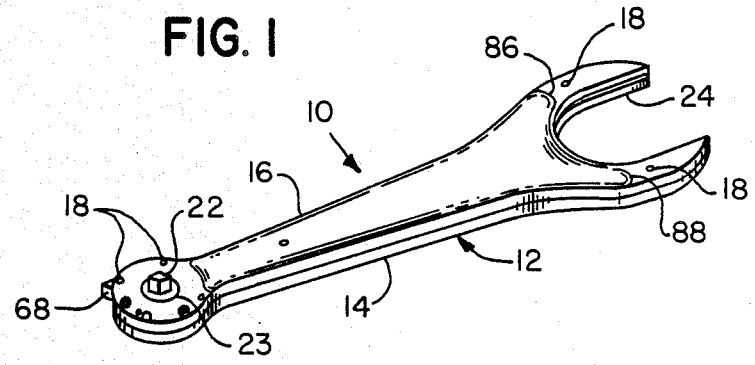
FIG. 2
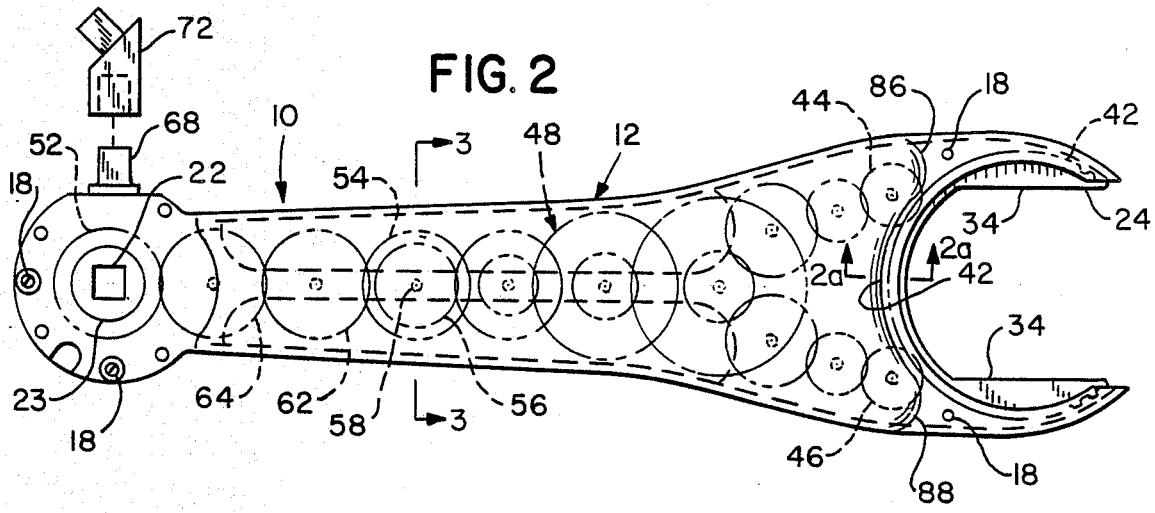
FIG. 5
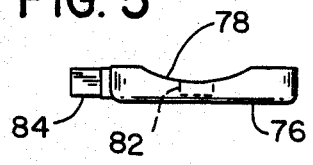
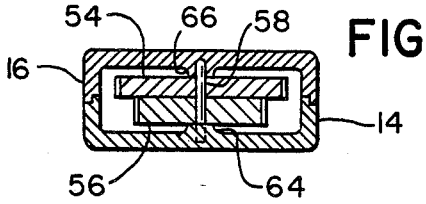
FIG. 3
FIG. 6
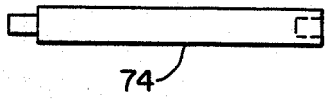
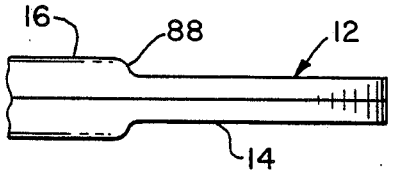
FIG. 4

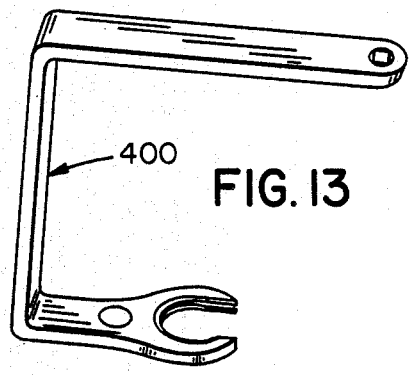
FIG. 13
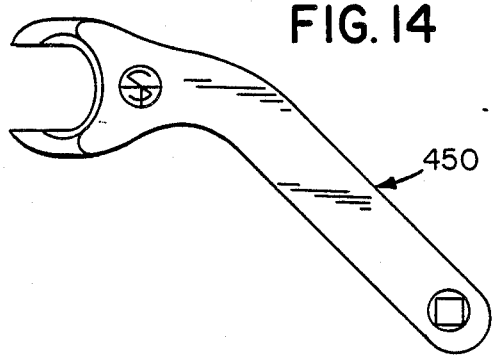
FIG. 14
FIG. 15
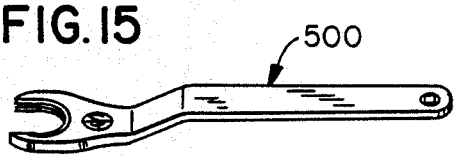
FIG. 17
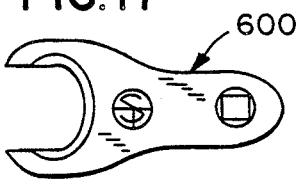
FIG. 16
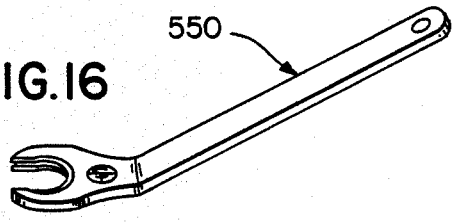
FIG. 18
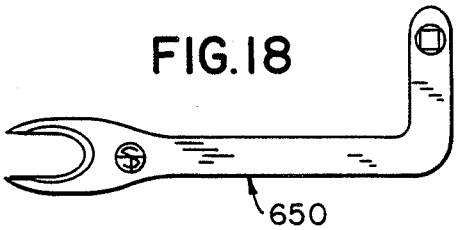
FIG. 20
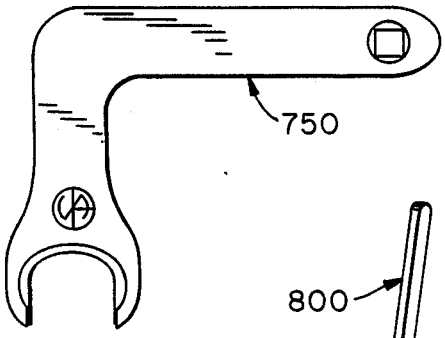
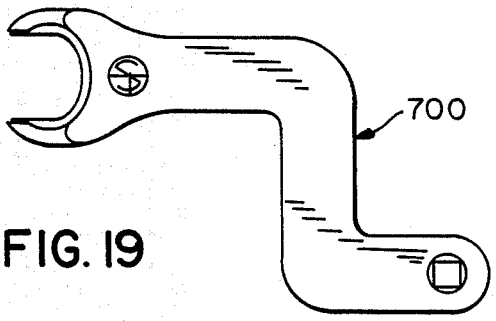
FIG. 19
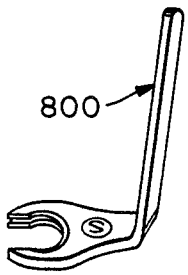
FIG. 21

TORQUE MASTER

BACKGROUND OF THE INVENTION

This invention relates to a torque multiplying wrench and more particularly to a wrench small enough to be hand held and capable of providing large increases in torque with minimum effort by the user.

Many presently available devices for providing high torque lack the ability to induce turning force in the plane of the nut or bolt. Furthermore, many of them suffer from one or more major limitations. In several, these devices are heavy and require bulky stabilizing reaction arms. In addition, many are unable to work around an obstacle such as a pipe or operate in confined spaces, or even reach a nut from the side. Another drawback of existing torque multipliers is their relatively high cost and in many cases the need to have more than one person apply the tool.

Furthermore, new bolting technology is rapidly replacing riveting and welding methods in a variety of construction and engineering industries. Although the evolution of this technology has been rapid, the corresponding development of supporting tools has lagged far behind.

In my U.S. Pat. No. 4,506,567 issued on Mar. 26, 1985 I show a maximum capability wrench which was designed as a hand tool for mechanics, hobbyists, "do-it-yourselfers", and others, to remove, for example a stubborn nut, or to reach in places where the work to be performed does not permit rotation of the wrench itself. While the patented tool has proven to be useful under the particular set of circumstances described, it has turned out not to be adequate for the major applications described above, for a variety of reasons. For these applications, the use of the chain drive produces an inadequate amount of torque multiplication. In addition, no provision is made to deal with the large reaction forces. Also, the patented tool does not permit repairs to be readily made by the user, a feature which might be expected for a small, inexpensive tool useful for relatively light applications. For the kinds of applications concerned about herein, the ability to make repairs in the field is an important advantage.

SUMMARY OF THE INVENTION

In the present invention the problems associated with devices in use up to now for torque multiplication are largely overcome in a tool small and light enough to be hand held but at the same time capable of providing very large increases in torque as well as large torques with very little effort required on the part of the user.

In accordance with the principles of this invention there is provided a new, unique and revolutionary tool which is a light-weight, compact, hand-held device designed to solve a number of longstanding problems associated with wrenches and similar tools currently in use. In addition the tool is versatile and generally superior to other products of this nature.

Wrenches incorporating this invention should find broad application in the workplace and improve the efficiency of existing industrial methods. In a broad sense they are designed to satisfy the demands of the new, sophisticated industrial bolting technology. Although tools which embody the present invention can be used in heavy industrial applications, they have characteristics which make them very versatile and allow them to be used in lighter operations as well. They operate, for example, in both the stationary and non-stationary mode and multiply applied torque by factors of from 3 to 267 times or higher depending on the model. Each model, however is invariant in torque-multiplication. They provide operation without movement of the tool body making it ideal for use in limited spaces. They operate around the center of the nut, eliminating destructive twisting and shearing forces. Further, they can also function as open-ended ratchet wrenches that use their own bodies as anti-reaction arms. They can be driven by standard hand-torque wrenches, electric or air-driven type nut runners.

It is thus a principal object of this invention to provide a wrench having torque multiplying capability at reduced weight and cost and having features rendering it useful in situations heretofore considered to be inaccessible for such tools.

Other objects and advantages of this invention will become obvious from the following description of preferred embodiments of this invention.

BRIEF DESCRIPTION OF THE DRAWINGS

FIG. 1 is an isometric view of a preferred embodiment of this invention.

FIG. 2 is a plan view of the wrench shown in FIG. 1.

FIG. 3 is a section along 3—3 of FIG. 2.

FIG. 4 is a side view of the right end of the wrench shown in FIG. 2.

FIG. 5 is a side view of an accessary for use with a reaction arm.

FIG. 6 is a side view of an extension arm.

FIGS. 13–21 show alternative embodiments of the invention for a variety of locational or spatial restrictions.

DETAILED DESCRIPTION OF THE PREFERRED EMBODIMENTS

Figure 2A:
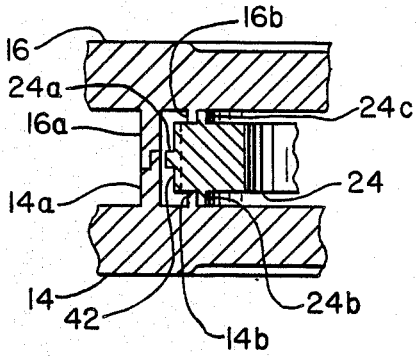
FIG. 2*a* is a section along 2*a*—2*a* of FIG. 2.
Figure 2B:
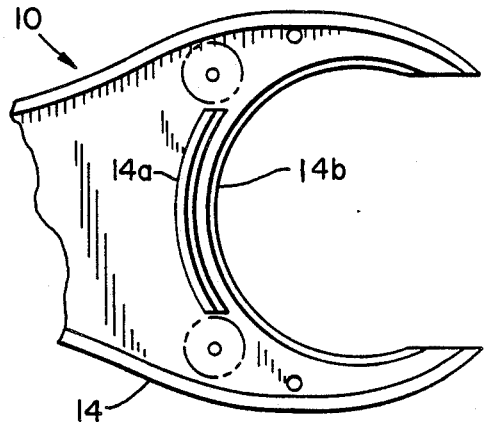
FIG. 2*b* is a detail of the jaw portion of one half of the housing.

Referring to FIGS. 1, 2, 2*a*, 2*b* and 3, it will be seen that wrench 10 consists of a housing 12 made up of a lower portion 14 and an upper portion 16. A number of screws 18 may be employed to hold the two parts of housing 14 together.

Figure 7:
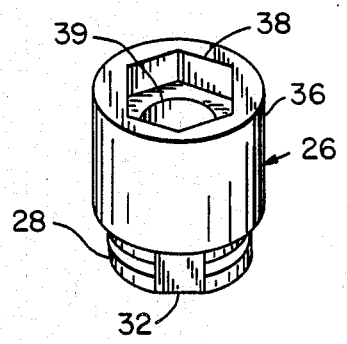
FIG. 7 is an isometric view of a socket to be used with the wrench shown in the preceding figures.

At one end is a male drive member 22 shown extending through opening 23 in housing 12 while at the other end is a driven jaw 24 shaped to accomodate socket accessory 26 shown in FIG. 7. Socket accessory 26 has a lower section 28 which fits within jaw 24 with a pair of flat surfaces 32 to make contact with the flat surfaces 34 of jaw 24 with the consequence that rotation of jaw 24 causes the rotation of socket accessory 26. The upper section 36 is provided with socket 38 to fit on the nut to be engaged. A hole 39 passing completely through socket 38 makes it possible to accomodate any protruding bolt. As is understood in the art, socket accessory 26 would come in different size openings 38 and the correct accessory 26 would be selected for the job to be undertaken.

It will be noted from FIG. 2 that jaw 24 has an incomplete outer circumference of gear teeth 42 driven by a pair of pinions 44 and 46 connected to one end of a gear train 48 whose other end is engaged with male drive member 22 through a gear 52. As seen in FIG. 3, in particular, gears 54 and 56 are integral with each other and mounted on a removable post 58. Gear 54 is connected to drive member 22 through a series of gears 62, 64 and gear 52, while gear 56 is connected through a series of gears to pinions 44 and 46 to drive jaw 24 as illustrated in FIG. 2.

FIG. 3 illustrates in section an important feature of this invention. Along the inside of lower section 14 of housing 12 is a raised spine 64 extending along the central axis which supports one end of post 58 and the posts supporting all of the other gears shown in FIG. 2 except for gear 52. Upper section 16 has a matching raised spine 66. This arrangement makes it convenient for the user of wrench 10 to replace any gear which becomes defective in use, typically, because of the high loads on the teeth. By removing post 58 if gear 54, for example, were defective, or any other post supporting a failed gear, a replacement can readily be made on the scene with little downtime. In addition, the use of raised spines 64 and 66 makes it possible to make the walls of housing 12 relatively thin and of reduced weight without sacrificing strength.

Located at the driven end and extending right angles to the length of wrench 10, is a male post 68 of square cross section. It has been found that when drive member 22 is engaged by a wrench or other tool (not shown) to rotate jaw 24 there is a considerable reaction torque equal to the driving torque which is exerted on wrench 10. Because the application of wrench 10 is in situations beyond the ability of any worker to contain that reaction force without a great deal of effort, the use of reaction post 68 makes it possible to engage a series of accessories such as adapter 72 (seen in FIG. 2) and extension 74 in FIG. 6 to make contact with existing structure to contain the reaction force. The accessory 76 shown in FIG. 5 is a solid member with a dished out section 78, a rectangular hole 82 therethrough to act as a female for engagement, and a male engaging member 84. Accessory 76 can be utilized to have dished out section 78 make contact with a pipe, if available, to absorb the reaction forces. By combining the various accessories just described and others which can be shaped or sized to meet any possible situation, the user of the wrench has available to him the means for readily setting wrench 10 up in such a way as not to have any concerns with unmet reaction forces. Of course, wrench 10 can be flipped over in the event the reaction force is in the opposite direction to that shown in FIG. 2, the direction depending on which way jaw 24 is to be rotated.

Another feature of wrench 10 is that the area of housing 12 adjacent jaw 24 is very narrow in depth. it will be noted from FIGS. 1, 2 and 4 that housing 12 narrows at the locations indicated by numerals 86 and 88, on both sides of the wrench, which makes it possible to insert jaw 24 in locations where all of housing 12 will not fit.

It has been mentioned that wrench 10 is employed in situations where very high torques are applied. In order to provide additional support to jaw 24 to prevent its expansion under high loads, as seen in FIGS. **2*a* and 2*b*, lower and upper portions 14 and 16 of housing 12 are provided with curved walls 14*a* and 16*a*, respectively, interlocking as illustrated. Jaw 24 is provided with a shoulder 24*a* which rises above the level of teeth 42 and extends almost to walls 14*a* and 16*a*. Shoulder 24*a* does not ordinarily contact walls 14*a* and 16*a*, but in the event jaw 24 enlarges under load, support is provided by walls 14*a* and 16*a***.

In addition, lower and upper portions 14 and 16 of housing 12 are provided with side shoulders **14*b* and 16*b* for coming into contact with shoulders 24*b* and 24*c* when jaw 24** expands under load. These features permit operation under higher loads than heretofore thought to be possible for a wrench of this type and size.

In the embodiment just described it will be seen there has been provided a torque multiplying wrench capable of heavy duty applications which is capable of being assembled, installed and operated by any worker under virtually all conditions. For those situations where the amount of torque to be applied is critical it is understood that a torque measuring device or meter may be included in the wrench to indicate to the worker how much torque is being employed.

Figure 9:
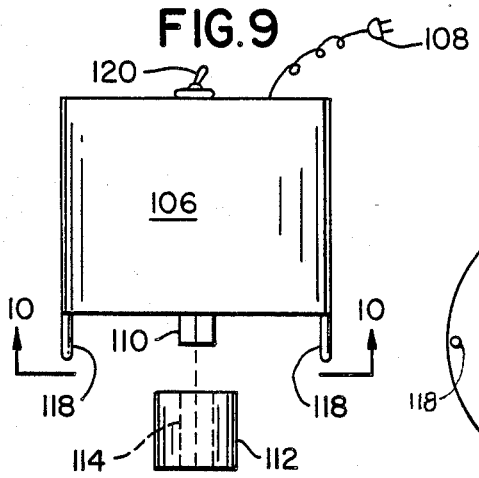
FIG. 9 is an elevation view of an accessory to be used with the driving end of the wrench shown in FIG. 8 for accomodating a driving wrench including an adaptor.
Figure 10:
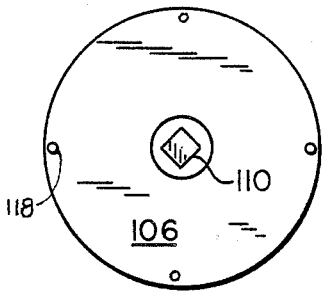
FIG. 10 is a view along 10—10 of FIG. 9.
Figure 8:
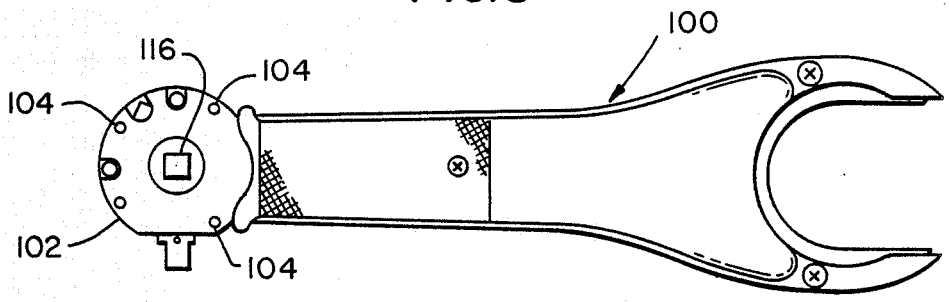
FIG. 8 is a plan view of an alternative embodiment of this invention.

Under some circumstances it may be necessary to apply to drive member 22 a torque which is even beyond the manual capability of the worker. For such a situation there is shown in FIGS. 8, 9 and 10 an alternative embodiment capable of meeting that need. There is shown a wrench 100 identical to wrench 10 of FIGS. 1–5 with certain additional features now to be described. At the driven end 102 of wrench 100 there is provided a group of four holes 104 in the housing arranged in any convenient fashion as shown. In FIGS. 9 and 10 is shown a drive pack 106 for receiving electrical power, typically 110 or 220 volt through a plug 108 and containing an electric motor (not shown) to power drive square shaft 110. An adapter 112 with an opening 114 is placed on drive member 116 of wrench 100 and power pack 106 is provided with legs 118 to enter holes 104 so that power pack 106 sits on the drive end of wrench 100, with adapter 112 insuring engagement of drive shaft 110 to drive member 116 since hole 114 is shaped and sized to accomodate both of the preceding. Switch 120 is then turned on to produce the power required to operate wrench 100. Legs 118 inserted into holes 104 absorb the reaction forces. Provision may be included, if desired, to select the speed and/or torque required, such as for example, a rheostat or a potentimenter, may be employed with a motor having that particular capability.

Under some circumstances where power is required and there is no electrical source convenient, a wrench incorporating the principles of this invention utilizing a portable source of power may be provided.

Figure 11:
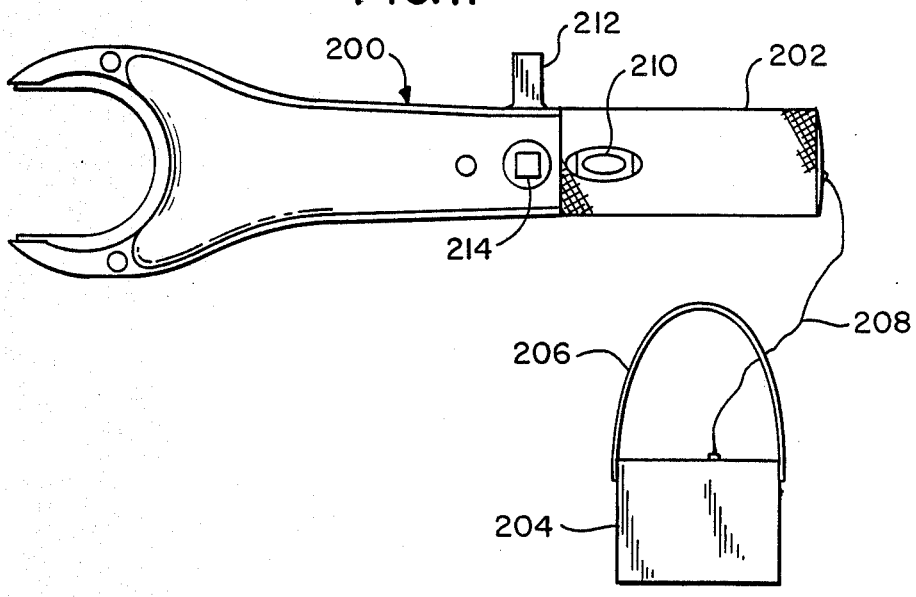
FIG. 11 is a combined plan and elevation view of another alternative embodiment of the invention.

Referring to FIG. 11, there is shown a wrench 200 like that of the preceding embodiments in which is mounted at the driven end a handle 202 containing a motor drive (not shown) and a battery pack 204 which can be slung over the shoulder of the worker using a strap 206 connected by wire 208 to the motor (not shown) within handle 202. A power switch 210 is illustrated to control the operation of the motor. Shown also are reaction posts 212 and 214 for use as described previously.

Figure 12:
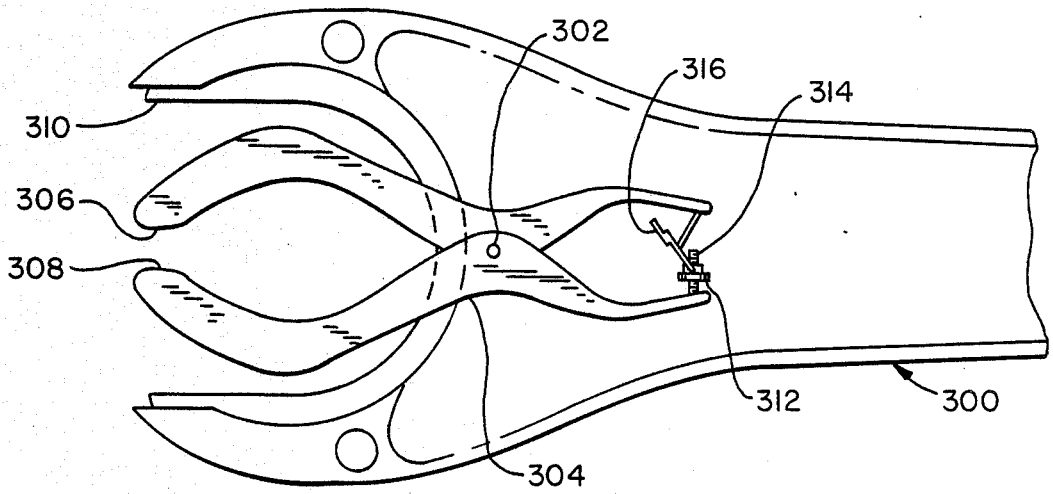
FIG. 12 is a plan view of an alternative embodiment similar to that of FIG. 8 having a locking arrangement.

Referring to FIG. 12 there is shown a wrench 300 similar to wrench 100 in FIG. 8 on which is mounted a post 302 supporting a gripper tool 304 having gripping arms 306 and 308 to clamp on a nut on the head of a bolt while jaw 310 grasps the head of the bolt or vice versa, to prevent the bolt from turning. Arms 306 and 308 are adjusted by a nut 312 on a threaded member 314 for tightness while a conventional snap lock arrangement 316 is employed to lock arms 306 and 308 in place. On the other side of wrench 100 another gripper tool (not shown) similar to that of gripper tool 304 may be employed.

For particular applications of the wrench embodying the principles of this invention, there may be locational or spatial requirements which could limit the use of the invention. To meet those needs, the present invention can be made in a variety of shapes, as shown in FIGS. 13–21.

In FIG. 13, wrench 400 having a u-shaped configuration is capable of reaching under an obstacle. Wrench 450 of FIG. 14 can reach around a corner or bend. Wrenches 500 and 550 of FIGS. 15 and 16 can reach under an interfering object, while wrench 600 of FIG. 17 can reach into a very tight space.

FIGS. 18–21 show wrenches 650, 700, 750 and 800 which can reach into places where the conventionally shaped wrench will not reach.

The configurations shown in FIGS. 13–21 can be accomplished by the use of bevel gears, worm gears, and other conventional such devices, as required.

Figure 22:
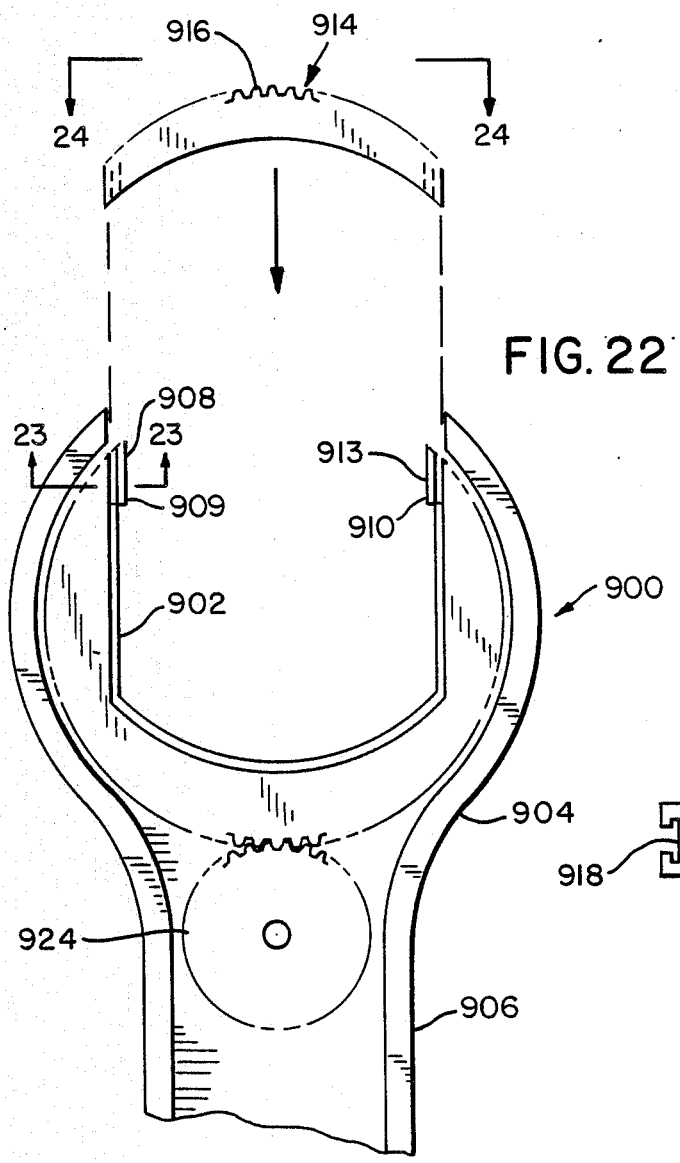
FIG. 22 is a partially exploded plan view of the jaw end of another alternative embodiment of the invention with the upper portion of the housing removed.
Figure 24:
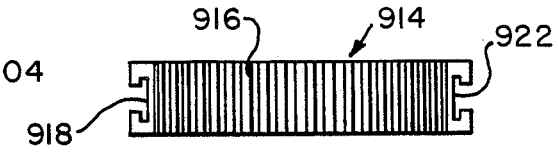
FIG. 24 is a section along 24—24 of FIG. 22.
Figure 23:
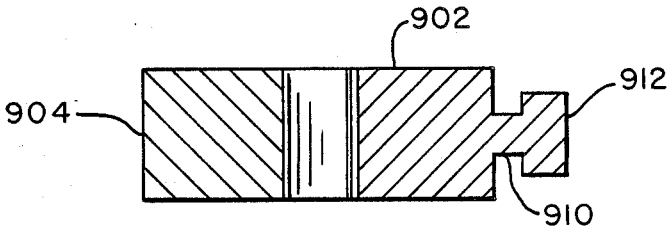
FIG. 23 is a section along 23—23 of FIG. 22.

In order to prevent any expansion of the jaw gear opening due to strong resistance by the bolt being worked on and which may cause damage to the jaw gear, a geared filler may be provided. Such an arrangement is shown in FIGS. 22, 23 and 24.

Wrench 900, similar to wrench 10 illustrated in FIG. 2, has a jaw 902 mounted in lower portion 904 of housing 906. Jaw 902 is provided in its extended end 908 with a section 909 having an extended projection 910 with an overhanging flange 912. Extended end 913 is provided with a similar but oppositely facing similar section 910.

A filler 914 is provided with an outer geared circular surface 916 having undercut grooves 918 and 922 to mate with sections 909 and 910 of jaw ends 908 and 913. When filler 914 is mounted on jaw 902, there are gear teeth completely surrounding rotatable jaw 902. Instead of using a pair of pinions to engage jaw 902 as in FIG. 2 showing a pair of pinions 44 and 46, if desired a single pinion 924 may be employed. The use of two pinions, however, may still be employed giving the user the option of whether to use filler 914 or not to employ it depending on circumstances, or if desired, three pinions may be employed.

The cut out sections on jaw extended ends 908 and 913 would be only sufficiently deep to accomodate filler 914 and have continuous gear teeth on the outside of jaw 902.

It is thus seen there has been provided a torque multiplying wrench capable of being employed under conditions requiring very high torques where heretofore expensive and heavy drive equipment have had to be employed, many times requiring the services of more than one worker.

While only certain preferred embodiments of this invention have been described it is understood that many variations of this invention are possible without departing from the principles of this invention as defined in the claims which follow.

What is claimed is:

1. A torque multiplying wrench comprising:

a. an elongated housing comprising a lower section and an upper section assembled to form said housing;

b. toothed jaw means within and adjacent one end of said housing exposed for engaging a member to be driven;

c. input drive means adjacent the opposite end of said housing for receiving an input driving force;

d. gear means for multiplying and delivering the torque received by said input drive means to said toothed jaw means;

e. said gear means including oppositely facing spine means within and extending down through the length of said housing means for supporting a plurality of removable posts to support gears for multiplying and delivering said torque, whereby upon removing said upper section a failed gear or post may readily be replaced by the user of said wrench;

f. said opposite end of said housing including means to transfer reaction forces away from said wrench and to select the direction of said reaction forces; and g. said toothed jaw means comprising a circular member with a jaw-like opening and flat side walls, side shoulders extending out from said toothed jaw means, and shoulders extending inwardly from both sections of said housing to engage said side shoulders when said toothed jaw means expands under load to limit expansion of said jaw means under load.

2. The torque multiplying wrench of claim 1 having support means mounted on said housing to limit expansion of said jaw means under load.

3. The torque multiplying wrench of claim 1 having accessories for engaging said reaction forces transfer means for selecting the direction where said reaction forces are transferred.

4. The torque multiplying wrench of claim 1 wherein said housing has leg receptacles arranged around said input drive means, electric motor means having legs for being received by said receptacles to support said motor means removable adapter means for connecting said motor means when mounted to said input drive means to drive said jaw means said legs and motor means being removable so that said wrench can be driven either by said motor means or by another input driving force.

5. The torque multiplying wrench of claim 4 wherein said motor means includes means to transfer reaction forces to said housing.

6. The torque multiplying wrench of claim 5 wherein said means to transfer reaction forces includes legs for supporting said motor means, said housing having receptacles for receiving said legs.

7. The torque multiplying wrench of claim 1 in which the opposite end of said housing is shaped as a handle, said input drive means and electric motor means for said drive means being located within said handle.

8. The torque multiplying wrench of claim 7 having an external battery pack joined by an electric wire to said motor means for powering said motor means.

9. The torque multiplying wrench of claim 1 having gripping means mounted on said housing for locking a portion of said member to be driven which is to remain stationary, said gripping means comprising a gripping tool having a pair of gripping arms adjacent the opening in said jaw means for clamping said portion of said member to remain stationary while said member is rotated by said jaw means, a post mounted on said housing for supporting pivotally said gripping arms, and means comprising a snap lock arrangement for locking said gripping arms on said portion of said member to remain stationary.

10. The torque multiplying wrench of claim 1 in which said support means includes a wall formed in said housing facing the teeth in said jaw means and said jaw means includes a shoulder for engaging under load said wall in said housing.

11. The torque multiplying wrench of claim 1 in which said toothed jaw means is open ended, and means toothed on the outside for closing the opening in said jaw means to permit said jaw means to be driven by a single pinion.

* * * * *